US006908248B2

(12) United States Patent
Pangburn

(10) Patent No.: US 6,908,248 B2
(45) Date of Patent: Jun. 21, 2005

(54) RING-CENTER PIVOT LOOSE-LEAF BINDER PAGE LIFTER

(76) Inventor: Daniel Wesley Pangburn, 501 Via Codo, Fullerton, CA (US) 92835-1453

( * ) Notice: Subject to any disclaimer, the term of this patent is extended or adjusted under 35 U.S.C. 154(b) by 0 days.

(21) Appl. No.: 10/639,921

(22) Filed: Aug. 14, 2003

(65) Prior Publication Data

US 2005/0036825 A1 Feb. 17, 2005

(51) Int. Cl.[7] ..... B42F 13/00

(52) U.S. Cl. ..... 402/80 L; 402/24; 402/73; 402/80; 402/80 R; 402/79

(58) Field of Search ..... 402/73, 80, 80 L, 402/80 R, 79

(56) References Cited

U.S. PATENT DOCUMENTS

| | | | | | |
|---|---|---|---|---|---|
| 2,035,284 | A | * | 3/1936 | Trussell | 402/39 |
| 2,090,231 | A | * | 8/1937 | Raynolds | 402/31 |
| 2,179,757 | A | * | 11/1939 | Schade | 402/80 L |
| 3,191,604 | A | * | 6/1965 | Wance | 402/39 |
| 3,306,301 | A | * | 2/1967 | Mason | 402/38 |
| 3,493,310 | A | * | 2/1970 | Byrne et al. | 402/24 |
| 3,591,300 | A | * | 7/1971 | Beyer | 402/80 L |
| 4,373,825 | A | | 2/1983 | Zabielski | |
| 4,420,271 | A | | 12/1983 | Zabielski | |
| 4,573,822 | A | | 3/1986 | Allen | |
| 5,503,489 | A | | 4/1996 | Maudal | |
| 5,549,406 | A | | 8/1996 | Cohen | |
| 6,200,058 | B1 | | 3/2001 | Maudal | |
| 6,273,630 | B1 | | 8/2001 | Sgro et al. | |
| 6,287,038 | B1 | | 9/2001 | Chan | |
| 6,371,678 | B1 | | 4/2002 | Chizmar | |
| 6,536,980 | B2 | | 3/2003 | To | |
| 6,558,064 | B1 | | 5/2003 | Tibbetts | |

* cited by examiner

*Primary Examiner*—Derris Banks
*Assistant Examiner*—Mark Henderson

(57) ABSTRACT

A page lifting device for use with loose-leaf binders containing binding rings. The leaves of the page lifter are formed from one or more stiff sheets of material or loops of stiff wire, rotatably affixed at their inner edges to an attaching member that is fixedly attached to the binding ring-base. The pivot axis between the leaves and attachment member is located close to the center of the substantially circular binder rings which, when the binder is closed, causes the page lifter leaves to envelope and lift the loose-leaf pages away from the binder spine. The page lifter leaves can contain slots or holes therein, which allow them to fit over the binder rings on closing.

2 Claims, 1 Drawing Sheet

RING-CENTER PIVOT LOOSE-LEAF BINDER PAGE LIFTER

CROSS-REFERENCE TO RELATED APPLICATIONS

Not applicable

STATEMENT REGARDING FEDERALLY SPONSORED RESEARCH OR DEVELOPMENT

Not applicable

REFERENCE TO AN APPENDIX

Not applicable

BACKGROUND OF THE INVENTION

1. Field of Invention

This invention relates to page lifting devices which are used to facilitate the closing of loose-leaf binders.

2. Description of the Prior Art

Many pages at the front and back of a binder, unless lifted, remain at the base of the rings near the spine of the binder on closing. Unless these pages are manually moved towards the top of the rings, or a functional page lifting device is used, the pages toward the front and back of the binder become jammed and damaged. Also, because of the jammed pages, the binder is prevented from closing all the way.

A variety of devices are in common use which are intended to lift or protect loose-leaf pages. Many of the available devices require either some manual lifting of the pages on closing the binder, or reduce the number of pages that the binder will hold, or are of complicated construction and therefore are somewhat costly, or any combination of these.

The number of such devices in common use and the failure of many to be wholly effective without manual assistance emphasizes the need for a page lifting device which is both effective and simple, as presently described. In addition, some embodiments of the present invention will be particularly suited to use with binders having more than the typical two or three rings.

The primary problem with all presently used page lifters is that the lifters pivot at or near the ring cover resulting in the pivot axis of the page lifter being substantially offset from the axis that the pages pivot around. This requires that the pages slide on the lifters while the binder is being closed which puts the pages at risk of damage and/or causes them to jam between the binder covers and the binder rings.

Prior art has described devices with the pivot axis aligned with the axis of the rings but these have been complex, expensive and/or required features to be incorporated into the binder during manufacture.

BRIEF SUMMARY OF THE INVENTION

The solution to these problems is a simple device that can be readily added to an existing binder or incorporated into a new binder. The device has an attaching member that fixedly attaches to the binder ring-base cover and page lifters that rotationally attach to the attaching member. The height of the attaching member is such that the pivot axis of the page lifters is approximately coincident with the axis of the substantially circular binder rings. The attaching member is fixedly attached to the ring-base cover using pressure sensitive adhesive having a peel-off protective cover. This feature, although not previously thought of, particularly distinguishes the present invention.

One object of the present invention is to provide an effective page lifter which will itself not be caught at the base of the binder ring by the pressure of the loose-leaf pages. This is accomplished either by locating the leaves of the page lifter between the binder rings, or by cutting holes or slots in the leaves of sufficient size to pass over the rings without binding on closing, or by using a loop of stiff wire to form the page lifter.

Another object of the present invention is to provide a page lifter which, on closing the binder, will lift all of the pages of a filled binder.

Another object of the present invention is to retain full capacity of the binder.

A further object of the present invention is to offer a page lifting device which, while wholly effective, is simply and inexpensively made.

Page lifters as herein described could be installed as part of the binder manufacturing process.

It is also intended that the invention as herein described will be made available to be retrofitted to existing binders by the user.

In the preferred embodiment, the page lifters are made as a continuous plastic extrusion cut to length to fit between binder rings and with a pressure sensitive adhesive surface applied on the base of the attaching member allowing the user to peel off a protective strip and press the attaching member of the page lifting device in place against the ring cover. This embodiment would be particularly attractive as a retrofit. An alternate embodiment is made from stiff paper with the rotatable attachment to the top of the attaching member being accomplished with a thin flexible section of the material or with bonded cloth.

The attaching member can also be mounted by flexible means such as pressure sensitive adhesive on foam with the adhering surface protected by a peelable material.

The page lifters should substantially conform to the configuration of the open binder. That part of the page lifter that lies against the binder cover when the binder is open will also lie against the binder cover when the binder is closed. This configuration results in minimum distortion of the pages in the open binder and maximum retained capacity of the binder.

BRIEF DESCRIPTION OF THE DRAWINGS

FIGS. 1 and 2 show the binder with the left cover in the closed position and the right cover in the fully open position. FIG. 3 is an end view with both covers part way between open and closed.

FIG. 1 shows a top view of the preferred embodiment in which the leaves and attachment member are joined by flexible material, such as tape, or a thin section in the material used for either leaves or attachment member, and the attachment member is attached to the ring-base cover with pressure sensitive adhesive on the surface that interfaces with the ring-base cover. The pressure sensitive adhesive surface would be protected by a peelable material that would be peeled off before pressing the attachment member in place on the ring-base cover.

FIG. 2 is an end view of the binder and page lifter shown in FIG. 1.

FIG. 3 is an end view of the preferred embodiment showing the binder covers part way between open and closed.

FIG. 4 is a perspective view of the preferred embodiment showing the pressure sensitive adhesive with peel-off protective cover.

FIG. 5 is like FIG. 4 except the pressure sensitive adhesive is on foam tape.

DETAILED DESCRIPTION OF THE INVENTION

Figure 1:
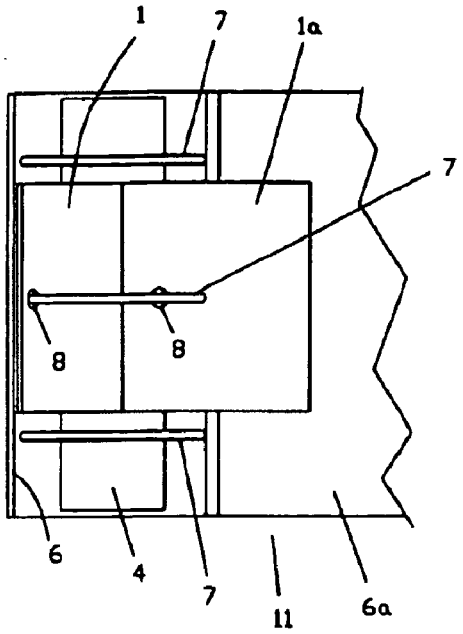
FIGS. 1, 2 and 3 all show a ring binder with a page lifter installed.

FIG. 1 is a top view showing the preferred embodiment of the page lifter installed in a binder 11 with the left cover 6 of the binder in the closed position and the right cover 6*a* of the binder shown flat in the open position. The preferred embodiment of the page lifter, shown in FIGS. 1, 2, and 3, consists of leaves 1 and 1*a* thin sections 2 and 2*a* functioning as flexure hinges, an attaching member 3 and pressure sensitive adhesive 5 to adhere member 3 to the ring-base cover 4 of a binder. The flexing hinges 2 and 2*a* provide a center of rotation for the leaves 1 and 1*a* that is at the approximate axis of the binder rings 7. This embodiment could be formed as a single plastic extrusion cut to length to fit between binder rings. The leaves can contain holes 8 or slots to provide clearance to accommodate one or more binder rings.

Figure 2:
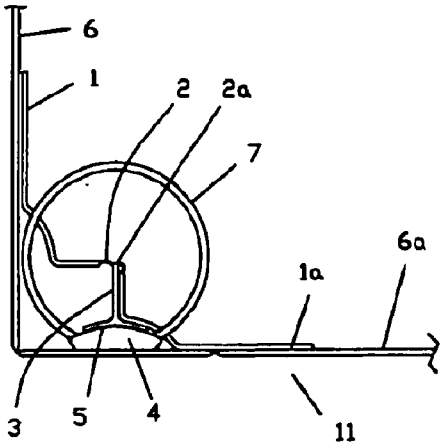

FIG. 2 is an end view of FIG. 1.

Figure 3:
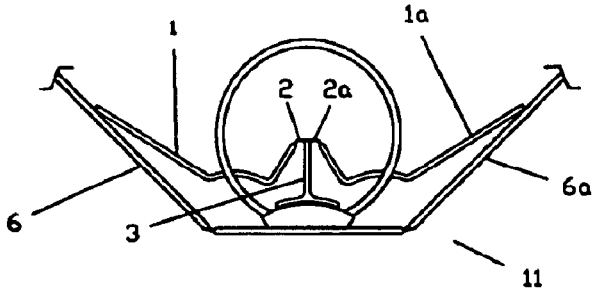

FIG. 3 is an end view of the preferred embodiment showing the binder covers 6 and 6*a* part way between open and closed. This shows how the page lifters 1 and 1*a* rotate about their pivot axis, which is near the axis of the binder rings, to lift the pages around the binder rings 7 without pushing the pages against the binder rings which could cause the pages to jam or be damaged.

Figure 4:
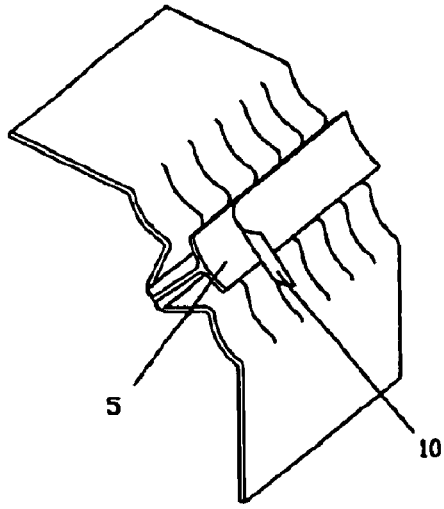
FIGS. 4 and 5 are perspective views showing the pressure sensitive adhesive, foam tape and peel-off protective cover.

FIG. 4 is a perspective view of the preferred embodiment showing the pressure sensitive adhesive 5 and peel-off protective cover 10.

Figure 5:
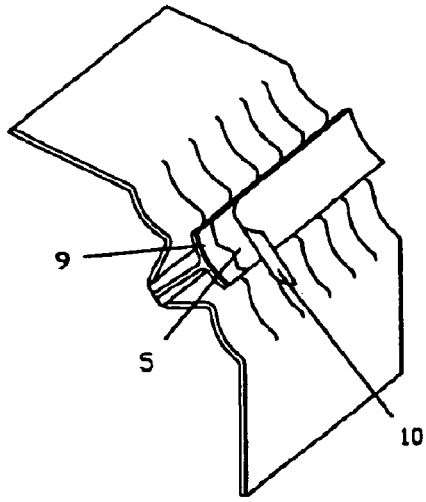

FIG. 5 is like FIG. 4 except that the pressure sensitive adhesive 5 is on a surface of foam tape 9.

Although the invention is described with respect to preferred embodiments, modifications thereto will be apparent to those skilled in the art. Therefore, the scope of the invention is to be determined by reference to the claims which follow.

What is claimed is:

1. A page lifting device, for use with a loose-leaf binder having front and back covers with inside surfaces that substantially face each other when the binder is closed, binding rings each of which when closed approximately forms a circle having a center and a line connecting the centers of at least two binding rings defines an axis, and a binding-ring base cover, which comprises:

a) at least two page lifter portions hinge-mounted to an attaching member, b) at least one said page lifter portion located in front of any pages contained in the binder and at least one page lifter portion located behind them, c) each page lifter portion having an inner edge towards the hinge and an outermost edge away from the hinge, d) the attaching member having a height of the hinge above the binding-ring base cover such that the hinge is located at approximately the axis of the binding rings, e) said page lifting device is made from a material where a thin section of the material forms a flexure acting as the hinge, f) said attaching member is fixedly attached to the binding-ring base cover with pressure sensitive adhesive with a peel-off protective cover, whereby on closing the loose-leaf binder the outermost edges of the page lifter portions encounter the inside surfaces of the loose-leaf binder's front and back covers, forcing said page lifter portions to rotate about said hinge thereby lifting said pages on the binding rings away from the binding-ring base cover preventing the pages from being caught between the binding rings and the inside surfaces of the loose-leaf binder's front and back covers.

2. A page lifting device, for use with a loose-leaf binder having front and back covers with inside surfaces that substantially face each other when the binder is closed, binding rings each of which when closed approximately forms a circle having a center and a line connecting the centers of at least two binding rings defines an axis, and a binding-ring base cover, which comprises:

a) at least two page lifter portions hinge-mounted to an attaching member, b) at least one said page lifter portion located in front of any pages contained in the binder and at least one page lifter portion located behind them, c) each page lifter portion having an inner edge towards the hinge and an outermost edge away from the hinge, d) the attaching member having a height of the hinge above the binding-ring base cover such that the hinge is located at approximately the axis of the binding rings, e) said page lifting device is made from a material where a thin section of the material forms a flexure acting as the hinge, f) said attaching member is fixedly attached to the binding-ring base cover with foam tape having pressure sensitive adhesive with a peel-off protective cover, whereby on closing the loose-leaf binder the outermost edges of the page lifter portions encounter the inside surfaces of the loose-leaf binder's front and back covers, forcing said page lifter portions to rotate about said hinge thereby lifting said pages on the binding rings away from the binding-ring base cover preventing the pages from being caught between the binding rings and the inside surfaces of the loose-leaf binder's front and back covers.

* * * * *